US008138460B1

(12) United States Patent
Margaryan et al.

(10) Patent No.: US 8,138,460 B1
(45) Date of Patent: Mar. 20, 2012

(54) RADIO FREQUENCY PHOTOTUBE

(75) Inventors: Amur Margaryan, Yerevan (AM); Karlen Gynashyan, Yerevan (AM); Osamu Hashimoto, Sendai (JP); Stanislaw Majewski, Morgantown, WV (US); Linguang Tang, Yorktown, VA (US); Gagik Marikyan, Yerevan (AM); Lia Marikyan, legal representative, Yerevan (AM)

(73) Assignee: Jefferson Science Associates, LLC, Newport News, VA (US)

( * ) Notice: Subject to any disclaimer, the term of this patent is extended or adjusted under 35 U.S.C. 154(b) by 228 days.

(21) Appl. No.: 12/660,966

(22) Filed: Mar. 8, 2010

(51) Int. Cl.
*H01J 43/00* (2006.01)
*H01J 31/00* (2006.01)
*H01J 25/76* (2006.01)

(52) U.S. Cl. ..... 250/207; 250/214 VT; 313/534; 313/103 CM

(58) Field of Classification Search ..... 250/207, 250/214 VT; 313/103 CM, 105 CM, 528, 313/529, 530, 532, 534, 541
See application file for complete search history.

(56) References Cited

U.S. PATENT DOCUMENTS

| | | | | | |
|---|---|---|---|---|---|
| 2,475,644 | A | * | 7/1949 | Soller | 315/12.1 |
| 2,674,661 | A | * | 4/1954 | Law | 330/42 |
| 3,243,628 | A | * | 3/1966 | Matheson | 313/103 R |
| 3,513,345 | A | * | 5/1970 | Feaster | 250/216 |
| 3,916,255 | A | * | 10/1975 | Crandall | 315/5.24 |
| 3,973,117 | A | | 8/1976 | Bradley | |
| 4,327,285 | A | | 4/1982 | Bradley | |
| 4,595,375 | A | * | 6/1986 | Kinoshita et al. | 445/14 |
| 4,611,920 | A | | 9/1986 | Tsuchiya | |
| 4,677,341 | A | * | 6/1987 | Kinoshita et al. | 315/12.1 |
| 4,694,154 | A | | 9/1987 | Tsuchiya | |
| 4,698,544 | A | * | 10/1987 | Kinoshita et al. | 313/379 |
| 4,916,543 | A | | 4/1990 | Crosby | |
| 5,103,083 | A | * | 4/1992 | Reed et al. | 250/214 VT |
| 6,384,519 | B1 | | 5/2002 | Beetz | |
| 2011/0220802 | A1 | * | 9/2011 | Frisch et al. | 250/363.03 |

* cited by examiner

*Primary Examiner* — John Lee

(57) ABSTRACT

A method and apparatus of obtaining a record of repetitive optical or other phenomena having durations in the picosecond range, comprising a circular scan electron tube to receive light pulses and convert them to electron images consisting with fast nanosecond electronic signals, a continuous wave light or other particle pulses, e.g. electron picosecond pulses, and a synchronizing mechanism arranged to synchronize the deflection of the electron image (images) in the tube (tubes) with the repetition rate of the incident pulse train. There is also provided a method and apparatus for digitization of a repetitive and random optical waveform with a bandwidth higher than 10 GHz.

10 Claims, 4 Drawing Sheets

RADIO FREQUENCY PHOTOTUBE

The United States of America may have certain rights to this invention under Management and Operating Contract DE-AC05-060R23177 from the United States Department of Energy.

FIELD OF THE INVENTION

The present invention relates to photon sensitive radio frequency (RF) phototubes and more particularly to a single photon sensitive RF phototube for measuring ultra low levels and ultra fast light pulses with picosecond time resolution.

BACKGROUND OF THE INVENTION

At present photon detection is carried out with solid state devices, vacuum photo multiplier tubes (PMTs) or hybrid photon detectors (HPDs). These instruments also provide fast signal timing information necessary in different fields of science and engineering. In high energy particle physics and nuclear physics experiments the time precision limit for the current systems consisting of particle detectors based on PMTs or HPDs and common nanosecond technology electronics (amplifiers, discriminators, and time-to-digital converters) is about 100 ps (FWHM).

However, it is well known that timing systems based on radio frequency (RF) fields can provide precision of the order of 1 ps or better (see e.g. E. K. Zavoisky and S. D. Fanchenko, Physical principles of electron-optical chronography, Sov. Phys. Doklady 1 (1956) 285 and A. M. Prokhorov and M. Ya. Schelev, Recent research and development in electron image tubes/cameras/systems, International Congress on High-Speed Photography and Photonics, Proc. SPIE 1358 (1990) 280).

Streak cameras, based on similar principles, are used routinely for measurements in the picosecond range (see for example D. J. Bradly, Ultra-short Light Pulses, Picosecond Techniques and Applications, in Topics in Applied Physics, 18 (1977) 17), and have found an increasing number of applications, in particular, in particle accelerators, permitting both precise measurements and instructive visualizations of beam characteristics and behavior that cannot be obtained using other beam instrumentation, (see for example K. Scheidt, Review of Streak Cameras for Accelerators: Features, Applications and Results, Proceedings of EPAC 2000, Vienna (2000) 182).

A Circular Scan Streak Tube (CSST) systems have been proposed for detecting, recording and temporally resolving optical events on the order of picosecond. Much of the investigation in this field has been conducted as part of developing a space borne laser ranging system.

Several possible kinds of readouts for circular scan streak tubes have been considered. The Photochron IIC streak tube as reported in 1984 included a phosphor screen at the output of the tube, covered by a fiberoptic faceplate. The streaked output images were recorded photographically on film. (See W. Sibbett et al, "Photochron IIC streak tube for 300 MHz circular-scan operation," SPIE Vol. 491 High Speed Photography (Strasbourg 1984)). This method provides a data record length limited to a single scan.

Later, improved signal detection was reported in W. Sibbett and W. E. Sleat, "A Photochron IIC Circular-scan Streak Camera with CCD Readout", SPIE Vol. 674 High Speed Photography (Pretoria 1986), pp 543-558 and A. Finch, et al, "Electron-sensitive CCD Readout Array for a Circular-scan Streak Tube," SPIE Vol. 591 Solid State Imagers and Their Applications (1985), pp 31-37. Both of these papers describe the Photochron IIC as a system including a circular array target comprising an array of photodiodes as sensing elements and a CCD shift register to read out the resulting charge. While sensitivity was improved, this arrangement is no less limited in record length to data collected over a single circular scan of the electron beam. After one scan, it is necessary to blank the writing beam, or deflect it off of the electron-beam-sensitive portion of the target to avoid overwriting.

C. B. Johnson, et al, "Circular-scan streak tube with solid-state readout", Vol. 19, No. 20 Applied Optics (Oct. 15, 1980) describes a circular-scan streak tube (CSST) having a circular photodiode array as a sensing element. The array is optically fiber-coupled to the output phosphor screen of the tube. The array readout circuitry is gated or triggered responsive to the first (start) and second (stop) laser pulses to record first and second streaked output signals, respectively, on the readout array, for measuring the time between the laser pulses. Thus, the acquired data is single-shot rather than continuous recording.

A commercial streak camera and readout system is the Hadland 2DR system, described in D. L. Bowley, "Measuring Ultrafast Pulses," Lasers & Optronics, September 1987, pp 81-83. The Hadland 2DR target employs a rectangular area CCD array, optically fiber-coupled to the camera. It apparently operates in a single-scan, triggered mode.

Philip S. Crosby, "Circular scan streak tube with electronic memory and readout" U.S. Pat. No. 4,916,543, describes a circular scan streak tube system for recording fast optical data having a first array of detection elements and a second array of corresponding storage elements. Changes in the scanning electron beam current representing optical events are detected and stored in the first array. The first and second arrays are segmented into two halves for continuous operation. Data stored in one half of the first array is transferred into the corresponding storage elements, while new data is written into the second half of the first array. Data stored in the first array is transferred in parallel to the second array. After a triggering event, the data are shifted circumferentially through the second array for output as serial data. The target is formed in a unitary planar semiconductor substrate having a buried channel for storing and conducting electric charge representing the stored data. In this way it enables detecting and storing event signal data over a time interval equal to several times the period of the electron scan. It provides averaged and slow information.

Daniel Joseph Bradley, "Electron-optical image tubes and streak cameras" U.S. Pat. No. 4,327,285, describes an improved method and apparatus for the study of optical phenomena generated by picosecond pulses and for the study of the pulses themselves. A record is obtained of repetitive optical phenomena having durations in the picosecond or sub-picosecond range by synchronizing the deflection of the electron image in an electron-optical streaking image tube with the repetition rate of a pulse train from a continuous wave mode-locked laser which supplies such pulses to the tube. Synchronization may be effected by supplying a reference frequency signal both to the laser and to the deflection electrodes in the image tube. The signal applied to the deflection electrodes may comprise a synchronized sinusoidal voltage signal and a slowly varying bias voltage signal. An optical multi-channel analyzer may be used at the output of the image tube, linked to an oscilloscope or pen recorder. It provides slow information.

Daniel Joseph Bradley, "Electron-optical image tubes" U.S. Pat. No. 3,973,117, describes an electron-optical image tube which avoids the limitations imposed by photographic and image storage techniques and which enables a direct linear intensity profile of a pulse train to be obtained. The image tube, instead of having a phosphor screen, has a disc with one or more slit apertures and photoelectron image is scanned across the aperture or apertures. Time spacing of the light pulses can be adjusted so that the time of the image tube coincides with the fixed aperture or apertures in the disc when a continuous circular scan is used. Maximum transmission of photo-electrons through the aperture is thus obtained, and these photo-electrons are collected and multiplied by an electron-multiplier mounted on the end wall of the image tube. The resulting electrical signal, amplified if necessary, is recorded for example with a pen recorder or oscilloscope. In this way it enables detecting and storing event signal data over a time interval equal to several times the period of the electron scan. It provides slow information.

Yutaka Tsuchiya, "Device for measuring extremely diminished intensity of light" U.S. Pat. No. 4,611,920, describes an electron tube device for measuring an extremely diminished intensity of light by superposing a plurality of streaking images of the light beams caused by fluorescence occurring in a phosphor layer where secondary electrons are incident thereon in single photon units. A streaking image is formed by secondary electrons generated within a streaking tube through which electrons generated in a photoelectric layer therein are accelerated to the phosphor layer therein when passing through a micro-channel-plate therein. The superposed streaking images with enhanced brightness are then picked up by a television camera. It provides slow information.

Yutaka Tsuchiya, "Instruments for measuring light pulses clocked at high repetition rate and electron tube devices therefore", U.S. Pat. No. 4,694,154, describes an electron tube device for measuring light pulses generated at a high repetition rate which includes an electron tube, power supply device and deflection voltage generator. The electron tube has a photocathode, focusing electrode, deflection electrodes, slit electrode, dynodes and a collector electrode positioned within an evacuated envelope. The power supply device supplies voltages to the dynodes and to the focusing and slit electrodes, and the deflection voltage generator supplies deflection voltages to the deflection electrodes which successively change in phase with respect to light pulses impinging on the photocathode so that different portions of the light pulses can be successively sampled. It provides slow information.

With a streak camera operating in the repetitive mode known as "synchroscan", a typical temporal resolution of 2 ps (FWHM) can be reached for a long time exposure (more than one hour) by means of proper calibration Wilfried Uhring et al., Very high long-term stability synchroscan streak camera, Rev. Sci. Instrum. 74 (2003) 2646.

The Cherenkov radiation have been detected by using synchroscan circular streak camera at early 1980s, A. E. Huston and K. Helbrough, The Synchroscan picosecond camera system, Phil. Trans. R. Soc. Lond. A298 (1980) 287-293. But commercially available streak cameras provide integral or slow information. They have been known as devices for measuring the temporal variation in intensity of a light emission which changes at high speed but in the past they did not find wide applications, including the high energy elementary particle and nuclear physics experiments.

A fundamental limitation of streak tube data readout is that optical events occur and can be recorded as data faster than the data can be readout electronically. This limitation constrains real time recording of optical events to a brief interval triggered by the event to be recorded.

Accordingly, the need remains for a circular scan streak tube capable of real time recording and storing event signal data over a long period of time, preferably hours or days.

OBJECT OF THE INVENTION

It is therefore an object of the present invention is to provide an RF phototube capable of providing a continuous ultra-fast stream of data responsive to a continuous optical events, in the form of fast nanosecond electronic signals, like regular photomultiplier signals, so that data corresponding to the single photoelectron is available for further processing by means of common nanosecond electronics.

It is another object of the present invention to provide a method and apparatus for the study of optical and other phenomena generated by picosecond pulses and for the study of the pulses themselves. As well as enabling basic scientific measurements to be carried out in the fields of physics, chemistry and biology, the method and apparatus of the present invention have applications also to medical imaging, optical communications, etc. In all these areas one can have phenomena occurring in a picosecond domain and at very high repetition rates, for example up to GHz.

It is yet a further object of the present invention to provide an arrangement whereby the RF phototube can be used to detect single photoelectron or secondary electron and to achieve accumulation of data at the output end of the tube in the form of fast nanosecond electronic signals.

It is an additional object of the present invention to provide an arrangement whereby the circular scan electron tube can be used to tag electronically any time decaying process in the picosecond domain which results in visible light or secondary electrons in the repetitive picosecond photon or other particle CW beams. This will enable not only to measure precisely the lifetimes of the time decaying process in the picosecond range but also achieve time coincidence with picosecond resolutions. The synchronization of the circular scan electron tube (tubes) RF deflecting voltage with the repetition frequency of the incident pulse train, means that successive events are superimposed precisely on one another and that more than one electron tube can be operated synchronously with picosecond resolutions. This means that one can obtain steady event information on the electron tube (tubes) in the form of fast nanosecond electronic signals. Data can be accumulated at a rate of the order of $5*10^8$ pulses per second. As mentioned above, steady event information can be obtained in the form of fast electronic signals, which can be used to tag electronically any time decaying process in the picosecond time domain which results in visible light or secondary electrons in the repetitive picosecond photon or other particle beams.

SUMMARY OF THE INVENTION

In accordance with the present invention there is provided a method of and apparatus for obtaining a record of repetitive optical or other phenomena having durations in the picosecond range, comprising a circular scan electron tube to receive light pulses and convert them to electron images consisting with fast nanosecond electronic signals, a continuous wave light or other particle pulses, e.g. electron picosecond pulses, and a synchronizing mechanism arranged to synchronize the deflection of the electron image (images) in the tube (tubes) with the repetition rate of the incident pulse train. There is also provided a method and apparatus for digitization of a repetitive and random optical waveform with a bandwidth higher than 10 GHz.

DETAILED DESCRIPTION

Figure 1:
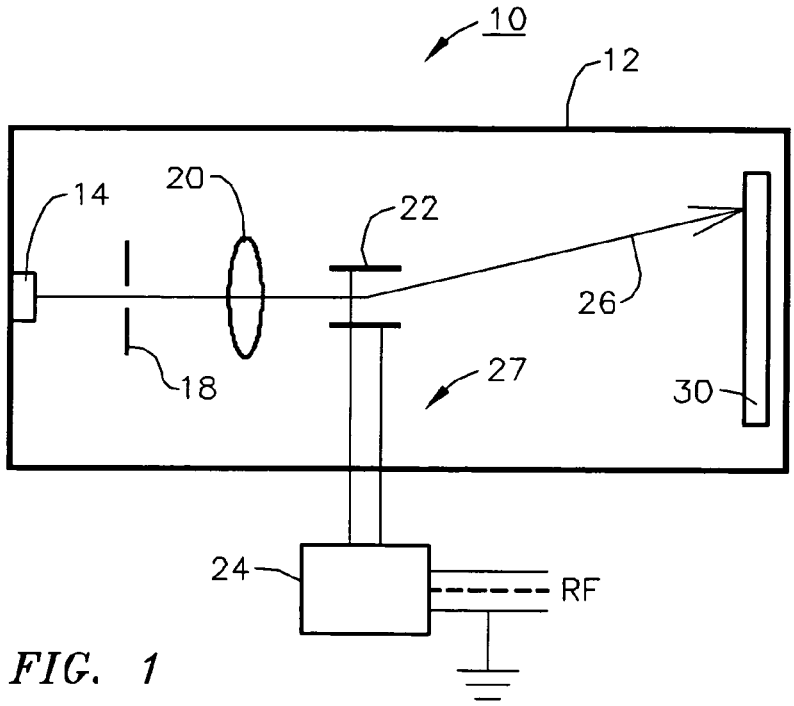
FIG. 1 is a schematic diagram of a RF phototube apparatus with point-size photocathode in accordance with the invention.

The RF phototube of the present invention for recording ultra low level and ultra fast optical signals includes a target having a dedicated circular scan deflection system which capable detecting event signal data and providing a continuous stream of data responsive to continuously scanning electron beam in the form of fast nanosecond electronic signals, like regular photomultiplier signals, for future processing in the picosecond time domain.

The RF phototube includes a photocathode, an electron gun, an electrostatic focusing system, a compact and sensitive 500 MHz RF deflector for circular scanning of the ~2.5 keV energy electrons and a fast position sensitive detector placed at the rear stage behind the focusing electrostatic lens system for the detection and determination the positions of the photoelectrons on the scanning circle.

A DC high voltage generating unit supplies operating voltages to the electron gun accelerating electrode, focusing electrostatic lens system and to the position sensitive detection system. A typically 500 MHz continuous wave RF sine voltage drives the RF deflector. The RF deflector can be operated alone or in synchronization with the RF modulated light sources and/or other RF phototubes.

Instead of using image storage techniques or integrated output devices such as streak cameras, the RF phototube includes a fast, high gain, position sensitive detection system which provides fast, nanosecond signals like regular photomultipliers. In this way the RF phototube combines all the advantages of the circular scan streak cameras and regular photomultipliers and can serve as a single photon sensitive detector with picosecond time resolution, that are useful in ultra low intensity applications such as detection of Cherenkov radiation in high energy particle and nuclear physics experiments, time resolved diffuse optical tomography, fluorescence spectroscopy, laser ranging and other.

In accordance with the present invention, there is provided a method and apparatus for heterodyning of two or more signals. The mixing of each two frequencies results in a creation of the difference of the two frequencies mixed. This is referred to herein as an optoelectronic heterodyning process. When used in conjunction with ultra-precise frequency standards such as optical clocks, the excess fractional frequency noise introduced in the optoelectronic heterodyning process can approach the value of $\sim 10^{-18}$.

Also in accordance with the present invention there is provided a circular scan RF phototube system comprising a photocathode for receiving light pulses and converting them to photoelectrons, an extracting electrode, and electrostatic focusing system at the emission side of the photocathode, a synchronizing signal generator to generate the synchronizing signals issued synchronously with the light pulses and/or other RF phototubes, electrostatic focusing system, deflection electrode means on the path of the photoelectrons beyond the extraction electrode, and electrostatic focusing system, a deflection voltage connection means to feed the sine wave deflection voltage signal to the deflection electrode, and position sensitive detector system at the rear side of the tube to receive photoelectrons or secondary electrons and record their positions on the circular path, providing position information in the form of fast nanosecond electronic signal for future processing.

Referring now to the accompanying drawings, FIG. 1 is a functional diagram, in side view, of a circular scan point-size photocathode of a 500 MHz RF phototube 10, in accordance with the present invention. The entire RF phototube assembly is disposed within a suitable container such as glass envelope or tube 12. The glass envelope 12 is evacuated to high vacuum. The RF phototube has an electron gun which includes a point like photocathode 14 for emitting electrons responsive to optical events impinging the photocathode at one end of tube 12. A beam of electrons 26 emitted from photocathode 14 passes through an extraction mesh 18. Electron beam 26 proceeds through an electrostatic lens 20 which may comprise, for example, a barrel anode or focusing plate, or a combination of both. Electron beam 26 passes next through RF deflection electrode 22.

The target for electron beam 26 is a dedicated circular scan electrode system 27 comprising RF deflection electrode 22 and quarter wavelength coaxial RF cavity 24. An RF sine voltage locked in phase with the RF modulated light sources, and/or other RF phototubes, is connected to deflection electrode 22 through the quarter wavelength coaxial RF cavity 24. Deflection electrode 22 and quarter wavelength coaxial cavity 24 form a resonance circuit with Q=130 at 500 MHz. In addition, the special design of deflection electrode 22 allows avoiding transit time effects. The sensitivity of this new and compact 500 Mhz RF deflector is about 0.1 rad/$W^{1/2}$ and is an order of magnitude higher than the sensitivities of the RF deflectors used previously, e.g. used in G. I. Bryukhnevitch, S. A. Kaidalov, V. V. Orlov, A. M. Prokhorov et al., PV006S Streak Tube For 500 MHz Circular-Scan Operation, Electron Tubes and Image Intensifiers, Proc. SPIE 1655 (1992) 143.

About 1 Watt (on 50 Ohm resistance) of RF power at 500 MHz is needed to deflect the 2.5 keV electron beam along a continuous path on a target 30. Target 30 is disposed near the end of the tube opposite the electron gun for receiving the deflected electron beam 26.

Figure 2:
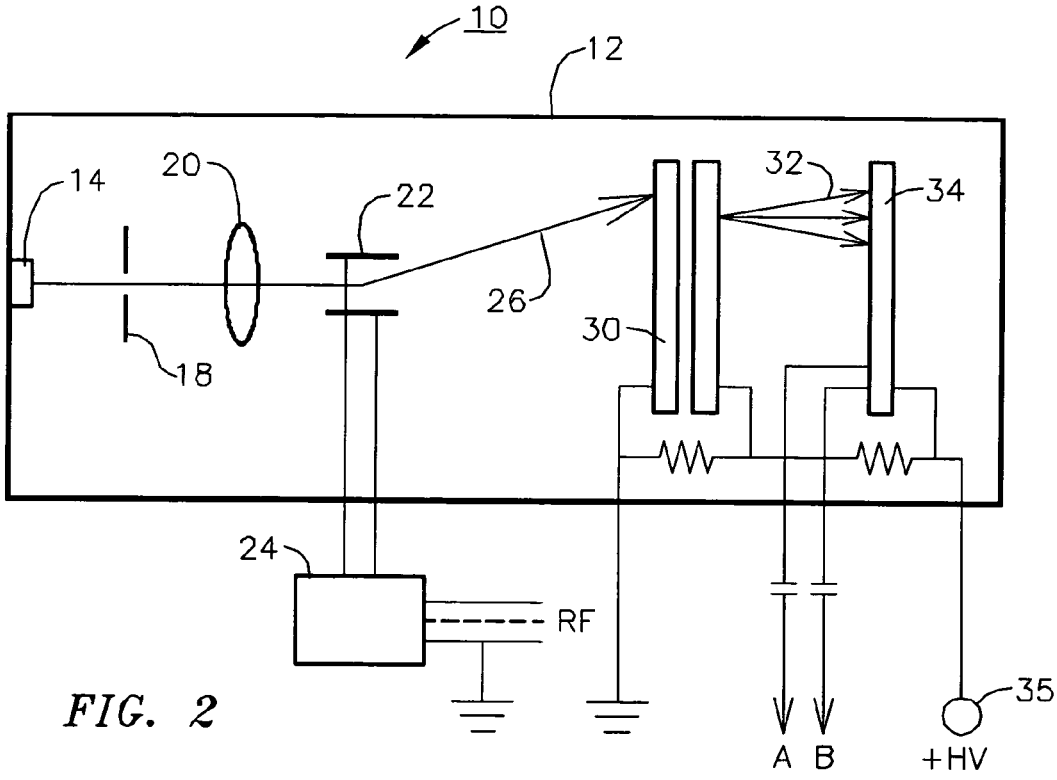
FIG. 2 is a schematic diagram of a RF phototube apparatus with point-size photocathode and position sensitive secondary electron detector based on microchannel plates in accordance with the invention.

A functional diagram of target 30 is shown in FIG. 2. The target includes a dual, chevron type micro channel plates (MCPs). A dual, chevron type, MCP detection system can be used to obtain a high gain of about $10^7$ and high rate capabilities (A. S. Tremsin et al., "Microchannel plate operation at high count rates: new results", Nucl. Instrum. and Methods A 379, 139 (1996)). Electron cloud 32 forms between target 30 and position sensitive 34. Each 2.5 keV electron is converted into on average to $10^7$ secondary electrons in dual, chevron type MCP detection system 30. A position-sensitive anode is situated about 3 mm behind the second MCP. It is biased at 300 V relative to the MCP output to allow electrons multiplied in the MCP reach the anode. The electron cloud size r.m.s at the position sensitive anode 34 is less than 1 mm (A. Margaryan, R. Carlini, R. Ent, N. Grigoryan, K. Gyunashyan, O. Hashimoto, K. Hovater, M. Ispiryan, S. Knyazyan, B. Kross, S. Majewski, G. Marikyan, M. Mkrtchyan, L. Parlakyan, V. Popov, L. Tang, H. Vardanyan, C. Yan, S. Zhamkochyan, C. Zorn, "Radio frequency picosecond phototube", Nuc. Instr. & Meth. A566 (2006) 321-326; A. S. Tremsin and O. H. W. Siegmund, "Spatial distribution of electron cloud footprints from microchannel plates: Measurements and modeling", Rev. of Sci. Instr. V.70, n. 8, (1999) 3282).

A DC high voltage generating unit 35 supplies operating voltage to the electrodes of RF phototube apparatus 10. More specifically, with respect to a reference potential, e.g.: ground potential, −2.5 KV and +3.0 KV may be applied to electron gun/photocathode 14 and dual, chevron type MCP detection system 30, respectively.

In contrast to the CSST tubes of aforesaid references and in accordance with the present invention, instead of phosphor screen or other average readout systems beyond the deflection electrode 22 of FIG. 1, the position sensitive detector detection system 30 is used.

Position determination can be performed in two basic architectures:

1. Interpolating readout: position sensor is designed in such a way that measurement of two signals (amplitudes) from position sensitive resistive anode defines the event position. In this way RF phototube serves a simple, easy to use, an ultra-fast optical detector for ultra-low level picosecond photon pulses, e.g. for detection of fast light pulses from Cherenkov radiation of high energy particles (RF Cherenkov picosecond timing technique for high energy physics applications, A. Margaryan, O. Hashimoto, S. Majewski, L. Tang, Nucl. Istrum. And Meth. A 48662 (2008) pages 274-277, A. Margaryan, O. Hashimoto, S. Majewski, L. Tang "RF Cherenkov picosecond timing technique for Jlab 12 GeV physics program", JLab L01-07-002, 2007; S. Majewski, A. Margaryan, L. Tang "Proposal for Cherenkov Time of Flight Technique with Picosecond Resolution", arXiv:physics/0508040); or for measuring the so-called temporal point spread function in diffuse optical tomography.

2. Direct readout: array of small (~mm$^2$) detection pixels, with one readout channel per pixel, defines event position. Position resolution in this case is about or better than the size of readout cell. In this way the RF phototube serves as an ultra-fast optical detector for ultra-low level photon pulses and also provides an optical waveform digitization capability with a bandwidth higher than 10 GHz for more complex receiver processing tasks, e.g. for digitization of fast light pulses in lunar laser ranging, quantum cryptography, medical imaging and etc. 500 MHz RF deflector transforms 2 ns time interval into of about 10 cm length scanning circle. In case of direct readout, each small (~1 mm$^2$) pixel operates as a 20 ps time gated independent photon detector and provides nanosecond signals. In this case the RF phototube operates as a 50 GHz sampling optoscope and can be used as an optical waveform digitization device in the nanosecond and subnanosecond domain with ~2 ps internal timing resolution. In such a system the background photon yield on each pixel will be 100 times less than the background which exists in 2 ns interval. This is a crucial issue for long distance free space quantum cryptography applications.

The position resolution limit for both cases is about $10^{-3}$ and in both cases time resolution technical limit is about 2 ps for 500 MHz RF deflector.

Svnchroscan operation mode: in this operation mode the rate of circular scan is adjusted to be equal to, or a multiple or sub-multiple of, the repetition rate of the light pulses in the pulse train from the continuous working mode-locked source of repetitive light pulses. Therefore, the photoelectron image of each light pulse always will coincide with the fixed spot on the scanned circle. Such an operating feature can be used in the case the device is used to detect rare delayed events produced in intense beams, and different readout is necessary to be used to detect intense pulses and delayed events. e.g. in time resolved fluorescence imaging or diffuse optical tomography. This for example further opens new possibilities in basic scientific measurements at the CEBAF facility, Jefferson Lab, USA (A. T. Margaryan, RF TIMING TECHNIQUE AND ITS POSSIBLE APPLICATIONS, Armenian Journal of Physics, 2009, vol. 2, issue 3, pp. 164-181, A. Margaryan, O. Hashimoto, S. Majewski, L. Tang "Study of Hypernuclei by Pionic Decay at Jlab", JLab LOI-07-001, 2007; A. Margaryan, RF picosecond timing technique and new possibilities for hypernuclear studies. The European Physical Journal A—Hadrons and Nuclei, V. 33, N3 (2007), p. 47, A. Margaryan, L. Tang, S. Majewski, O. Hashimoto, V. Likhachev, Auger Neutron Spectroscopy of Nuclear at CEBAF, Letter of intent to JLAB PAC 18, LOI-00-101, 2000; S. Majewski, L. Majling, A. Margaryan, L. Tang, "Experimental Investigation of Weak Non-Mesonic Decay of $^{10}$Be Hypernuclei at CEBAF", arXiv:nucl-ex/0508005;) or in particle accelerators applications, permitting precise measurements of beam characteristics that cannot be performed using other beam instrumentation (A. Margaryan, R. Carlini, N. Grigoryan, K. Gyunashyan, O. Hashimoto, K. Hovater, M. Ispiryan, S. Knyazyan, B. Kross, S. Majewski, G. Marikyan, M. Mkrtchyan, L. Parlakyan, V. Popov, L. Tang, H. Vardanyan, C. Yan, S. Zhamkochyan, C. Zorn, "Bunch time structure detector with picosecond resolution", Vasili Tsakanov and Helmut Wiedemann (eds.), Brilliant Light in Life and Material Sciences, 2007 Springer, 455-464).

From the temporal resolution budget, as discussed in R. Carlini, N. Grigoryan, O. Hashimoto, S. Knyazyan, S. Majewski, A. Margaryan, G. Marikyan, L. Parlakyan, V. Popov, L. Tang, H. Vardanyan, C. Yan, "Proposal for Photon Detector with Picosecond Time Resolution", Yerevan Physics Institute and Stanford Linear Accelerator, NATO ADVANCED RESEARCH WORKSHOP "Advanced Photon Sources and Their Applications" Nor Hamberd, Armenia, Aug. 29-Sep. 2, 2004, one can conclude that the expected parameters of the technique are:

a) Internal time resolution for each photo-electron of about 2 ps;
b) Technical time resolution in the range of $(2\text{-}10)\times10^{-12}$ sec for f=500 MHz RF deflector;
c) Absolute calibration of the system to better than $2\times10^{-13}$ sec is possible, which is an order of magnitude better than can be provided by a regular timing technique currently in use in high energy particle and nuclear physics experiments.

Figure 3:
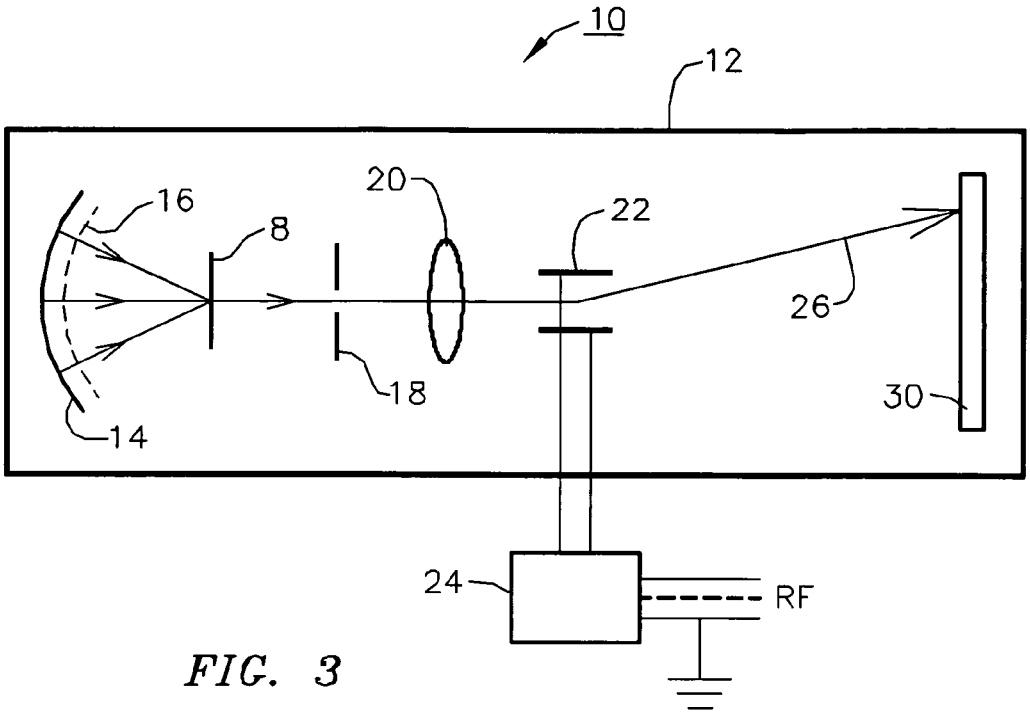
FIG. 3 is a schematic diagram of a RF phototube apparatus with large-size photocathode in accordance with the invention.

FIG. 3 shows a side view of a functional diagram of a circular scan large-size photocathode of a 500 MHz RF phototube 10, in accordance with the invention, which is needed in high-energy elementary particle physics and nuclear physics experiments. The entire RF phototube assembly is disposed within a suitable container such as glass envelope or tube 12. The glass envelope 12 is evacuated to high vacuum. The large-size photocathode is based on "spherical-capacitor"—type immersion lens. It implies a configuration consisting of two concentric spheres of which the outer one is a photocathode 14 and the inner one is an electron transparent electrode 16. This configuration has a number of advantages, e.g., the possibility of having high accelerating field near the photocathode, between photocathode 14 and electrode 16, it forms a perfect crossover outside of this electric field and a complete lack of transit time dispersions in the crossover for electrons with equal initial energies. The transmission dynode 8 is placed in the crossover. In a tube with similar structure and with 40 mm diameter photocathode but without transmission dynode 8, 10 ps (FWHM) temporal resolution has been achieved (Boris. E. Dashevsky, New electron optic for high-speed single-frame and streak image intensifier tubes, Proc. SPIE 1358 (1990) 561). The produced photoelectrons are accelerated in the "spherical-capacitor" region and focused on the crossover where they pass through transmission dynode 8 producing secondary electrons (SEs) on both sides of the dynode. Low energy SEs produced on the rear side of the transmission dynode are accelerated with the help of the electron transparent electrode 18 and enter into the electron tube which is the same as in the case of point size photocathode. Thus, with such a device, temporal resolution will be determined by the "spherical-capacitor" type immersion lens, because time dispersion of secondary electrons in the transmission dynode is less than 6 ps (E. W. Ernst and H. VonFoerster, Time Dispersion of Secondary Electron Emission, Appl. Phys. 26 (1955) 781). Hence, it becomes possible to attain a rather high (10 ps, FWHM) temporal resolution for large-size photocathode.

The RF phototube with RF driven photon source operates like heterodyne and mixes two frequencies: operational frequency of the RF deflector $f_o$ with photon pulse train frequency $f_{ph}$. In the case of $f_0 \neq f_{ph}$ (or equal to the higher harmonics of the $f_{ph}$), and ideally with no system drift, the position of electron beam spot will stay stable on the scanning circle. In the general case $f_{ph}$ does not equal $f_0$ and the electron beam spot will drift on the scanning circle with speed $v=2\pi R\ f_0-f_{ph}$. The drift is clockwise for $f_0>f_{ph}$ and counterclockwise for $f_0<f_{ph}$, respectively. This feature can be used for precise comparison of two close frequencies $f_0$ and $f_{ph}$.

Figure 4:
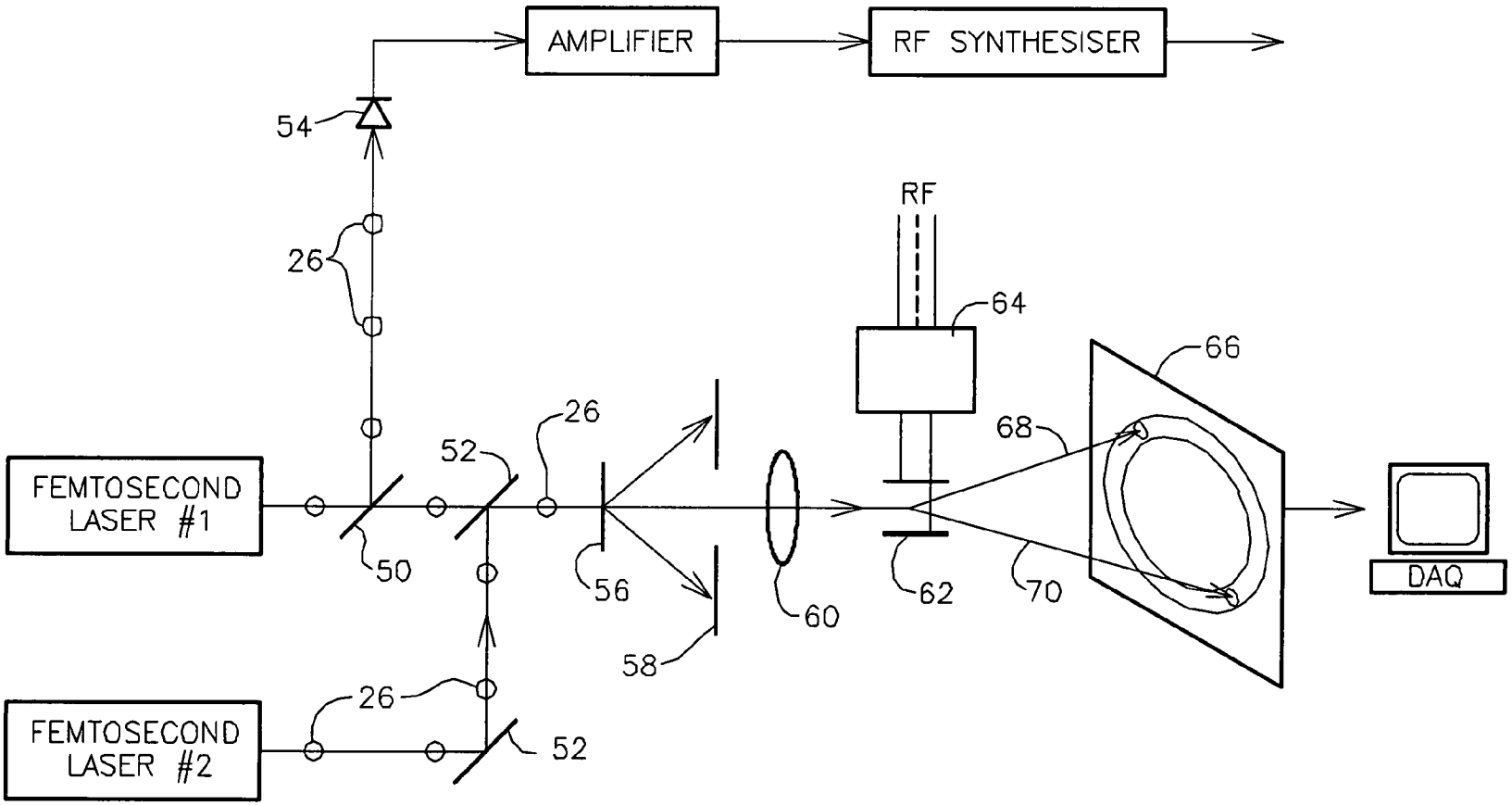
FIG. 4 is a functional diagram of an optoelectronic heterodyne based on RF phototube in accordance with the invention.

The streak camera working alone has about 0.6 ps/minute mean drift, even if $f_0=f_{ph}$. Similar drifts are expected in the case of RF phototube. These drifts can practically be excluded by using reference laser trace with photon pulse train frequency $f_{ref}$ and carrying out comparison of the test photon pulse train frequency-$f_{ph}$ with $f_{ref}$. We call this an optoelectronic heterodyning system and its functional diagram is shown in FIG. 4. The reference laser trace is split into two parts. One part is used to generate a sinusoidal signal, which is used in the RF synthesizer to generate necessary 500 MHz power for operation of the RF deflection system. The other part with test photon pulse train is directed to the phototube. Suppose $f_0=f_{ph}=10$ MHz. In that case photon beam paths can be selected to result 20 MHz photoelectron pulse train. Therefore, photoelectrons from both photon pulse trains, scanned and detected practically simultaneously, must have the same drift and very low relative drift. It was already demonstrated (Wilfried Uhring, Chantal Virgine Zint, Patrick Summ, Bemard Cunin, Very high long-term stability synchroscan streak camera, Rev. Sci. Instrum. 74 (2003) 2646), that by this way more than 200 fs/h temporal instability can be achieved. When an RF phototube is used in conjunction with precise frequency standards such as optical clocks, the excess fractional frequency noise introduced in the optoelectronic heterodyning process can approach the value of $\sim 10^{-18}$. Recently developed Optical Frequency Comb (OFC) technique translates optical frequency standards to microwave frequencies, S. A. Diddams, J. Ye, and L. Hollberg, Femtosecond lasers for optical clocks and low noise frequency synthesis, in Femtosecond Optical Frequency Comb: Principle, Operation and Applications, S. Cundiff and J. Ye, Eds. New York: Springer-Verlag, 2004, Th. Udem, R. Holzwarth, and Th. Haensch, Femtosecond optical frequency combs, Eur. Phys. J. Special Topics 172 (2009) 69. Then the optoelectronic heterodyning system based on the RF phototubes, can find applications in ultra precise measurements. In this case femtosecond lasers are replaced by optical clock systems, A. Margaryan, Optical Clock, Radio Frequency Timing Technique and a New Earth-Bounded Gravitational Red-Shift Experiment, Armenian Journal of Physics, V. 3, no. 1, 2010.

The above described principle can be used to organize a new High resolution (20 ps), High rate (~MHz) and Highly stable (10 fs/hrs) timing system. In this case FEMTOSECOND LASER #1 in FIG. 4 is replaced by OPTICAL CLOCK, while FEMTOSECOND LASER #2 by sample photons from the EXPERIMENT. This $H^3$ timing system can be used for precise measurements in high energy elementary particle and nuclear physics experiments, A. Margaryan, Radio Frequency Phototube, Optical Clock and Precise Measurements in Nuclear Physics, arXiv 0910.3011, 2009. In addition to this the proposed $H^3$ timing system extends the time range of the time-correlated single photon counting technique, W. Becker, Advanced Time-Correlated Single Photon Counting Technique, Springer Series in CHEMICAL PHYSICS, 81, 2005, to the subpicosecond domain.

To demonstrate the basic features of the RF deflection system, the RF phototube apparatus with a thermo-electron source and phosphor screen have been used. The devices utilized for these embodiments are depicted schematically in FIGS. 4-6 described below.

The sensitivity of the RF deflector resonator system is about mm/V, so by applying voltage 10 Vp-p we have ~2 cm in diameter circular scan for 2.5 keV electrons. The noise level from RF deflector resonator is about or less than 4 mVp-p. The signals from single thermo-electrons can be as higher as 100 mV, and fast electronic pulses from single photoelectrons can be used for future processing with out any problem.

Figure 5:
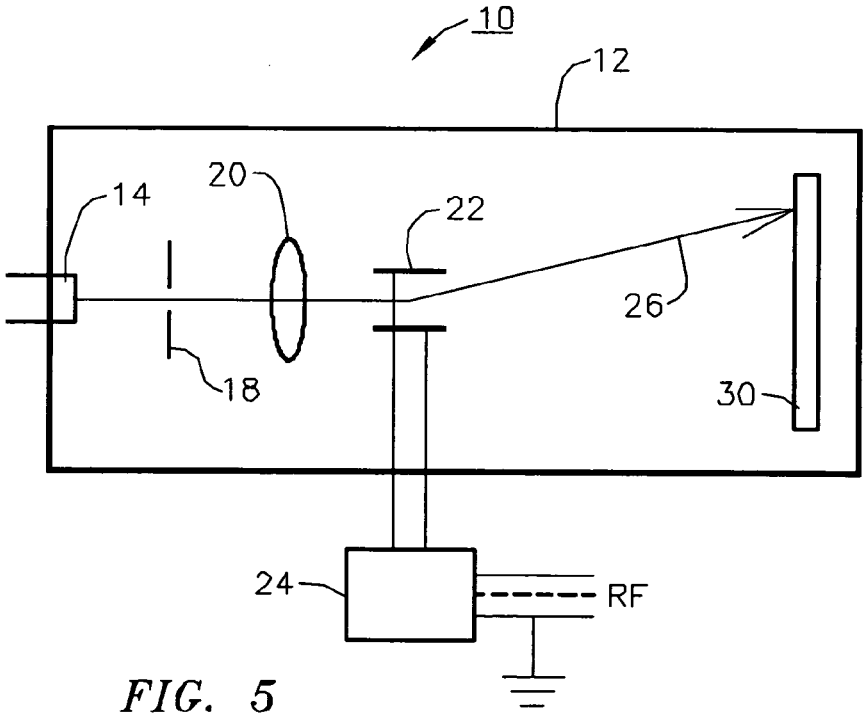
FIG. 5 is a schematic diagram of the RF phototube test apparatus with thermo-electron source.
Figure 6:
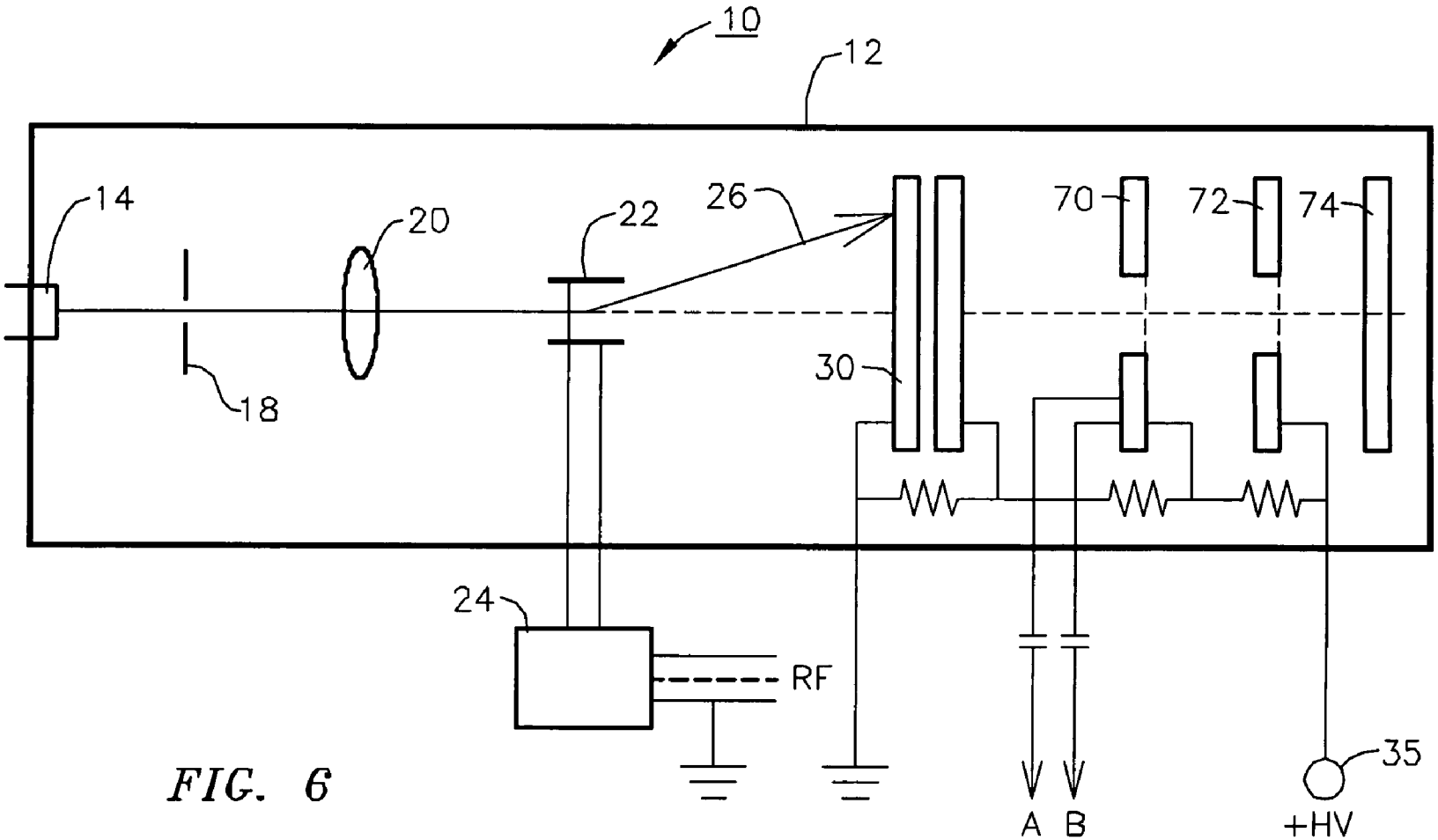
FIG. 6 is a schematic diagram of the RF phototube test apparatus with thermo-electron source, MCP detector and position sensitive anode system.

FIGS. 4-6 depict alternative element configurations of the detection system of the present invention. FIG. 4 is functional diagram of the optoelectronic heterodyne of the present invention comprising a beam splitter 50, reflectors 52, a photodiode 54, a photocathode 56, an accelerating electrode 58, an electrostatic lens 60, deflection electrode 62, a quarter-wavelength coaxial cavity 64, a position sensitive secondary electron detector 66, accelerated and deflected photoelectrons 68 and 70 from Laser #1 and Laser#2.

FIG. 5 depicts schematically the principles of the RF phototube of the present invention using a thermo-emitter as photocathode 14 and a phosphor screen as target 30.

FIG. 6 is a schematic depiction of the RF phototube of the present invention using a thermo-emitter in place of photocathode 14 and a position sensitive detector based upon micro channel plates. In this embodiment wherein like numbers refer to like elements as in the earlier Figures, the position sensitive detector comprises a position sensitive resistive anode 70 an accelerating harp 72, and a phosphor screen 74.

Although the invention has been described above in connection with time measurements in the picosecond range, where it is particularly valuable, it is not to be considered as being limited to this or any other operating range of time measurement. The technique, in accordance with the present invention, of using a sensitive circular scan RF deflector resonator system and a position sensitive detector can find wide application in the 100-1500 MHz frequency range.

As the invention has been described, it will be apparent to those skilled in the art that the same may be varied in many ways without departing from the spirit and scope of the invention. Any and all such modifications are intended to be included within the scope of the appended claims.

What is claimed is:

1. A circular scan RF phototube system including a container evacuated to high vacuum and within said container comprising:

an electron gun including a photocathode for receiving light pulses from a photon or particle continuous wave beam and converting said light pulses to photoelectrons, said photocathode including an emission side;

an electron transparent electrode;

an electrostatic focusing system at said emission side of said photocathode;

a synchronizing signal generator to generate synchronizing signals issued synchronously with said light pulses;

a deflection electrode on the path of said photoelectrons beyond said electron transparent electrode and said electrostatic focusing system, said deflection electrode deflecting said light pulses along a circular path;

a deflection voltage connection means, said deflection voltage connection means feeding a sine wave deflection voltage signal to said deflection electrode; and a position sensitive detector system to receive photoelectrons or secondary electrons from said deflection electrode and record the positions of said photoelectrons or secondary electrons on said circular path, thereby providing position information in the form of fast nanosecond electronic signals for processing by means of nanosecond electronics.

2. The circular scan RF phototube system of claim 1 wherein said position sensitive detector system includes a dual chevron microchannel plate detector and a position sensitive anode.

3. The circular scan RF phototube system of claim 1 including a DC high voltage generating unit for supplying operating voltages to said electron gun, said electron transparent electrode, said electrostatic focusing system, and said position sensitive detector system.

4. The circular scan RF phototube system of claim 1 including a continuous wave RF sine voltage for driving said deflection electrode, said deflection electrode capable of being operated alone or in synchronization with said light pulses.

5. The circular scan RF phototube system of claim 4 wherein said continuous wave RF sine voltage is connected to said deflection electrode through a quarter wavelength coaxial RF cavity.

6. The circular scan RF phototube system of claim 5 wherein said deflection electrode and said quarter wavelength coaxial cavity form a resonance circuit with Q=130 at 500 MHz.

7. The circular scan RF phototube system of claim 6 wherein said phototube system includes a sensitivity of 0.1 rad/$W^{1/2}$.

8. The circular scan RF phototube system of claim 1 including an internal time resolution for each of said photoelectrons of 2 picoseconds.

9. The circular scan RF phototube system of claim 1 including a technical time resolution in the range of $(2\text{-}10)\times10^{-12}$ seconds for said deflection electrode operating at 500 MHz.

10. The circular scan RF phototube system of claim 1 including an absolute calibration to at least $2\times10^{-13}$ seconds.

* * * * *